US010743383B2

(12) United States Patent
Chen

(10) Patent No.: US 10,743,383 B2
(45) Date of Patent: Aug. 11, 2020

(54) LED LIGHTING DEVICE DRIVEN BY BOOSTING ALTERNATING CURRENT

(71) Applicant: DST TECHNOLOGY CO., LTD., Tainan (TW)

(72) Inventor: Chi-Ting Chen, Tainan (TW)

(73) Assignee: DST Technology Co., Ltd., Tainan (TW)

( * ) Notice: Subject to any disclaimer, the term of this patent is extended or adjusted under 35 U.S.C. 154(b) by 0 days.

(21) Appl. No.: 16/589,350

(22) Filed: Oct. 1, 2019

(65) Prior Publication Data

US 2020/0113025 A1 Apr. 9, 2020

(30) Foreign Application Priority Data

Oct. 9, 2018 (CN) ..... 2018 2 1636172 U

(51) Int. Cl.
*H05B 33/08* (2020.01)
*H05B 45/37* (2020.01)

(52) U.S. Cl.
CPC ..... *H05B 45/37* (2020.01)

(58) Field of Classification Search
CPC ..... H05B 33/0812; H05B 33/0815; H05B 33/0845
USPC ..... 315/294, 307
See application file for complete search history.

(56) References Cited

U.S. PATENT DOCUMENTS

| | | | | |
|---|---|---|---|---|
| 7,791,285 | B2 * | 9/2010 | Wu | H05B 33/0803 315/227 R |
| 2011/0043136 | A1 * | 2/2011 | Radermacher | H05B 45/00 315/294 |
| 2012/0153854 | A1 * | 6/2012 | Setomoto | H05B 45/37 315/200 R |
| 2012/0206056 | A1 * | 8/2012 | Jung | H05B 33/0818 315/200 R |
| 2015/0222197 | A1 * | 8/2015 | De Vaal | H02M 7/04 307/33 |

* cited by examiner

*Primary Examiner* — Tung X Le
(74) *Attorney, Agent, or Firm* — Rosenberg, Klein & Lee

(57) ABSTRACT

An LED lighting device driven by boosting alternating current includes a mains AC input terminal, an LED lighting load, and an AC boosting driving circuit. The mains AC input terminal is configured to input mains electricity. The AC boosting driving circuit is electrically connected the mains AC input terminal and the LED lighting load, and is configured to perform forward boosting and reverse boosting for the mains electricity from the mains AC input terminal so that the voltage of the mains electricity is boosted to 1.5 to 6 times to be supplied to the LED lighting load. The LED lighting load achieves the same luminous efficiency, and the current flowing through the LED lighting load is reduced, thereby reducing the heat generated by the LED lighting load. The operating temperature of the LED lighting load is reduced. The service life is prolonged.

7 Claims, 5 Drawing Sheets

LED LIGHTING DEVICE DRIVEN BY BOOSTING ALTERNATING CURRENT

FIELD OF THE INVENTION

The present invention relates to an LED lighting device driven by boosting alternating current, and more particularly to an LED lighting device that is boosted by an AC boosting driving circuit. Under the premise that the same luminous efficiency is achieved by an LED lighting load, the required operating current is lowered to reduce the heat generated by the LED lighting load.

BACKGROUND OF THE INVENTION

With the development of science and technology, new products and technologies are constantly innovating. LEDs as new light sources have the characteristics of energy saving, environment-friendly and high efficiency. The LED technology has matured and is applied to various fields. Therefore, LEDs are widely used. In order to ensure that the LED load can be driven by the mains electricity, the industry produces LED products with an operating voltage in the peak voltage of the mains electricity, that is, in the range of 1.414 times the effective value of the mains electricity. Since the electric power is equal to the current multiplied by the voltage (W=V*I), if the voltage is limited and the luminous efficiency of the LED load is to be increased, only the amount of the LED load can be increased, or the current passing through the LED load can be increased. However, increasing the amount of LED load will increase the cost, and the increase in current will increase the heat generated by the LED load greatly, and the operating temperature is also increased greatly. Therefore, the service life of the LED load is shortened.

SUMMARY OF THE INVENTION

The primary object of the present invention is to provide an LED lighting device driven by boosting alternating current. Under the premise of the same luminous efficiency, the operating current required for an LED load is lowered to reduce the heat generated by the LED load.

An LED lighting device driven by boosting alternating current comprises a mains AC input terminal, an LED lighting load, and an AC boosting driving circuit. The mains AC input terminal is configured to input mains electricity. An operating voltage of the LED lighting load is 1.5 times to 6 times an effective voltage of the mains electricity. The AC boosting driving circuit is electrically connected the mains AC input terminal and the LED lighting load, and is configured to perform forward boosting and reverse boosting for the mains electricity from the mains AC input terminal so that the voltage of the mains electricity is boosted to 1.5 to 6 times to be supplied to the LED lighting load.

Preferably, the AC boosting driving circuit includes a forward boosting module and a reverse boosting module. A positive half cycle of the mains electricity is boosted by the forward boosting module, and a negative half cycle of the mains electricity is boosted by the reverse boosting module.

Preferably, the LED lighting device driven by boosting alternating current further comprises a capacitor array. A positive electrode of the capacitor array is electrically connected to an output terminal of the forward boosting module and a positive electrode of the LED lighting load. A negative electrode of the capacitor array is electrically connected to an output terminal of the reverse boosting module.

Preferably, the LED lighting device driven by boosting alternating current further comprises a constant current driver. The constant current driver is electrically connected to the LED lighting load so that a current passing through the LED lighting load is a constant value.

Preferably, the forward boosting module is a first diode.

Preferably, the reverse boosting module is a second diode.

Preferably, the capacitor array includes a first capacitor and a second capacitor. The first capacitor is electrically connected to the forward boosting module and the LED lighting load. The second capacitor is electrically connected to the reverse boosting module.

The reason for the voltage of the mains electricity to be boosted to 1.5 times to 6 times: the conventional circuit without the AC boost driving circuit is taken as an example, because the mains electricity is alternating current, the operating voltage of the LED lighting load using direct current will be less than the peak value of the voltage of the mains electricity, that is, 1.414 times the voltage of the mains electricity. Even if the voltage is unstable to result in that the voltage of the mains electricity is suddenly increased, the LED lighting load with an operating voltage that is 1.5 times or more the voltage of the mains electricity cannot be driven, so as to achieve the effect of 1.5 times of the present invention. The voltage resistance of most existing electronic components is less than 800V. When it is more than 800V, it is difficult for the electronic components to load, and expensive semiconductor materials are needed. This is less economical. When the mains electricity is 120V, 800V is equivalent to more than six times the mains electricity. Therefore, the voltage of the mains electricity is boosted to 1.5 times to 6 times, meeting different usage requirements.

According to the above technical features, the following effects can be achieved:

1. Through a simple component, such as the AC boosting driving circuit to boost the received mains electricity, the effective voltage of the mains electricity is boosted to 1.5 times to 6 times, so as to meet different usage requirements.

2. Because of the increase of the voltage across the LED lighting load, the LED lighting load achieves the same luminous efficiency, and the current flowing through the LED lighting load can be reduced, thereby reducing the heat generated by the LED lighting load. The operating temperature of the LED lighting load is reduced. The service life is prolonged. The power saving, energy saving, carbon reduction, and luminous efficiency are improved.

3. The residual voltage in the first capacitor and the second capacitor is discharged by the first resistor and the second resistor, thereby avoiding a danger caused by the residual voltage. In addition, it is also avoided that the residual voltage causes the overvoltage of the first capacitor or the second capacitor in the next use, thereby improving safety.

4. The constant current driver is configured to keep the brightness of the LED lighting load constant, so as to prevent the LED lighting load from flashing due to unstable current.

DETAILED DESCRIPTION OF THE PREFERRED EMBODIMENTS

Embodiments of the present invention will now be described, by way of example only, with reference to the accompanying drawings.

Figure 1:
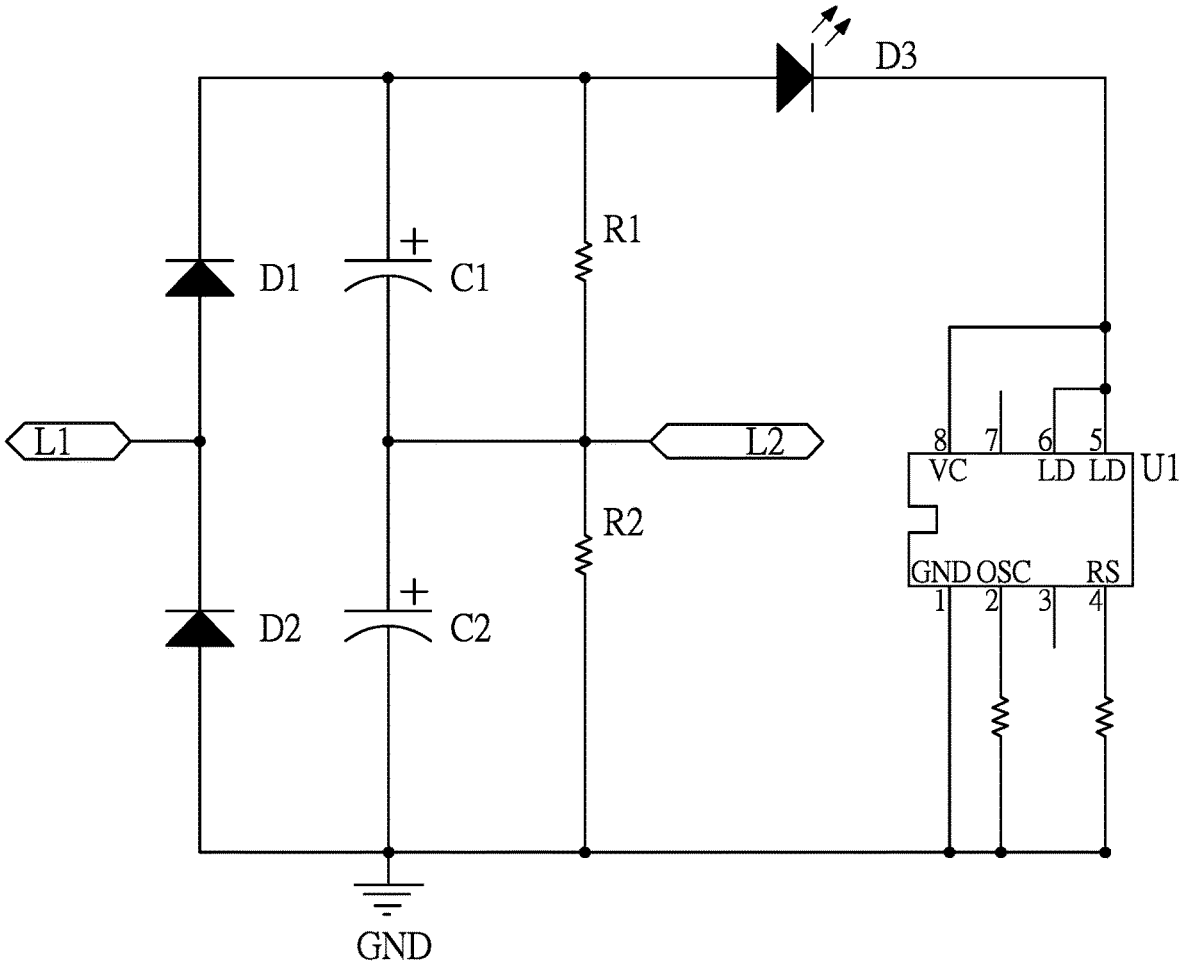
FIG. 1 is a circuit diagram of an embodiment of the present invention, illustrating an LED lighting device driven by boosting alternating current of the present invention.

Referring to FIG. 1, an LED lighting device driven by boosting alternating current comprises mains AC input terminals L1, L2, an AC boosting driving circuit, a capacitor array, an LED lighting load D3, and a constant current driver U1.

The mains AC input terminals L1, L2 are configured to input mains electricity.

The AC boosting driving circuit includes a forward boosting module and a reverse boosting module. In this embodiment of the present invention, the forward boosting module is a first diode D1, and the reverse boosting module is a second diode D2. The input terminal of the forward boost module, namely the anode of the first diode D1, is electrically connected to one of the mains AC input terminals L1, L2. The output terminal of the reverse boosting module, namely the cathode of the second diode D2, is electrically connected to the same mains AC input terminal L1, L2.

The capacitor array includes a first capacitor C1 and a second capacitor C2. The positive electrode of the first capacitor C1 is electrically connected to the cathode of the first diode D1. The negative electrode of the second capacitor C2 is electrically connected to the anode of the second diode D2 and connected to the ground.

One end of a first resistor R1 is electrically connected to the positive electrode of the first capacitor C1. The other end of the first resistor R1 is electrically connected to one end of a second resistor R2. The other end of the second resistor R2 is electrically connected to the negative electrode of the second capacitor C2.

The anode of the LED lighting load D3 is electrically connected to the cathode of the first diode D1.

The constant current driver U1 is configured to keep the brightness of the LED lighting load D3 constant, so as to prevent the LED lighting load D3 from flashing due to unstable current. The constant current driver U1 includes an input voltage pin VC. The input voltage pin VC is electrically connected to the negative electrode of the LED lighting load D3. The constant current driver U1 is commonly used in the art, and no further details are described hereinafter for concision.

Through the simple components such as the first diode D1 and the second diode D2, the effective voltage of the mains electricity is boosted to 1.5 times to 6 times and then supplied to the LED lighting load D3, so that the voltage across the LED lighting load D3 rises. The operating voltage of the LED lighting load D3 is 1.5 times to 6 times the effective voltage of the mains electricity. Because of the increase of the voltage across the LED lighting load D3, the LED lighting load D3 achieves the same luminous efficiency, and the current flowing through the LED lighting load D3 is reduced, thereby reducing the heat generated by the LED lighting load D3. The operating temperature of the LED lighting load D3 is reduced. The service life is prolonged. The power saving, energy saving, carbon reduction, and luminous efficiency are improved.

Figure 2:
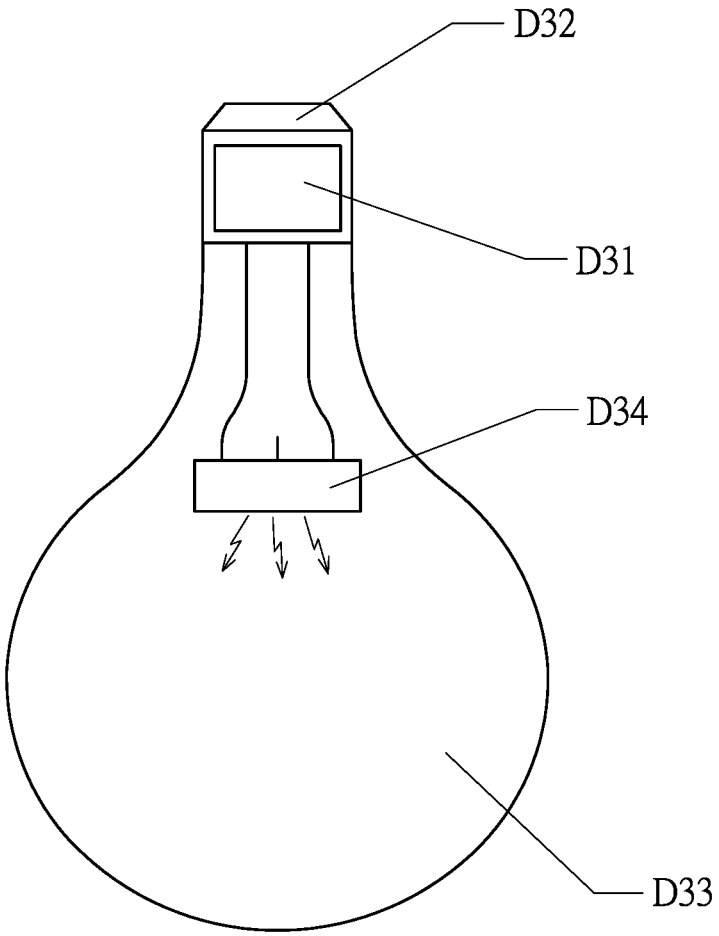
FIG. 2 is a schematic view of the embodiment of the present invention, illustrating that the LED lighting load of this embodiment is a light bulb.

Referring to FIG. 1 and FIG. 2, in this embodiment of the present invention, the LED lighting load D3 is a light bulb. The light bulb includes a circuit D31, a light bulb holder D32, a light bulb shell D33, and a lighting source D34. The AC boosting driving circuit may be directly disposed in the light bulb holder D32 as the circuit D31, or the AC boosting driving circuit and the circuit D31 are connected by wires outside the light bulb D3. It should be noted that the light bulb D3 is taken as an example only, and the AC boosting driving circuit is not limited to be applied to the light bulb D3. The AC boosting driving circuit may be used in any LED lighting device.

Figure 3:
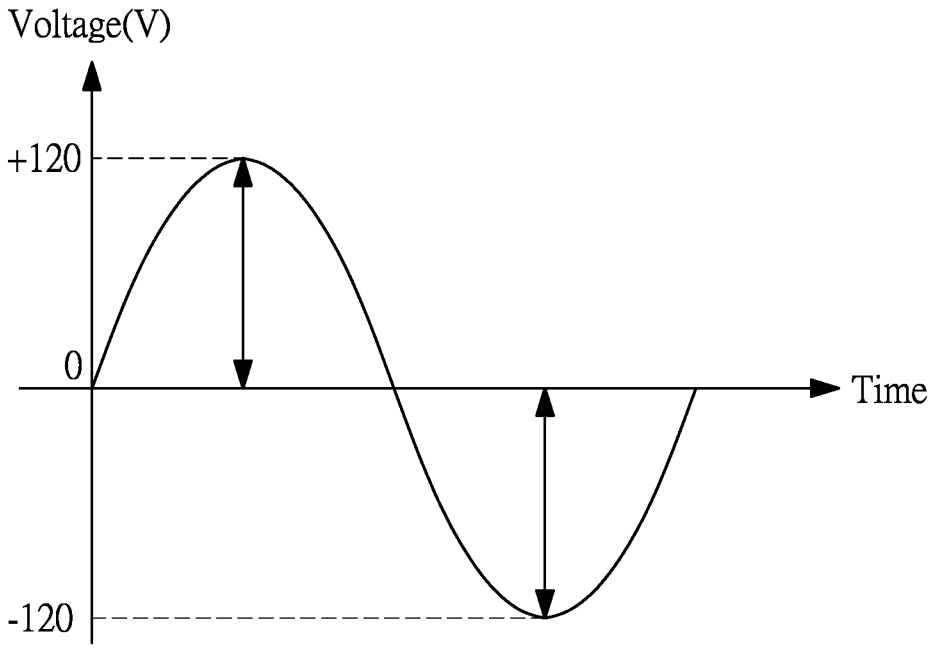
FIG. 3 is a diagram illustrating the relationship between the voltage and time of the mains electricity of the embodiment of the present invention.

FIG. 1 and FIG. 3 illustrate the flow and storage of the mains electricity from the mains AC input terminals L1, L2. When the mains electricity is in a positive half cycle, the mains electricity is boosted forward by the first diode D1, and the first capacitor C1 is charged. Since the voltage of the first capacitor C1 is less than the voltage of the LED lighting load D3, the mains electricity is stored in the first capacitor C1. When the mains electricity in a negative half cycle, that is, when the voltage of the mains electricity is less than 0, the mains electricity is boosted reversely by the second diode D2, and the second capacitor C2 is charged. Since sum of the voltage of the second capacitor C2 and the voltage of the first capacitor C1 equal to the voltage of the LED lighting load D3, the current of the mains electricity flows through the LED lighting load D3 so that the LED lighting load D3 emits light. At the same time, the first resistor R1 and the second resistor R2 performs filtering, and the constant current driver U1 performs constant current control, so that the current flowing through the LED lighting load D3 is a constant value.

After the input of the mains electricity is stopped, the residual voltage in the first capacitor C1 and the second capacitor C2 is discharged by the first resistor R1 and the second resistor R2, thereby avoiding a danger caused by the residual voltage. In addition, it is also avoided that the residual voltage causes the overvoltage of the first capacitor C1 or the second capacitor C2 in the next use, thereby improving safety.

Figure 4:
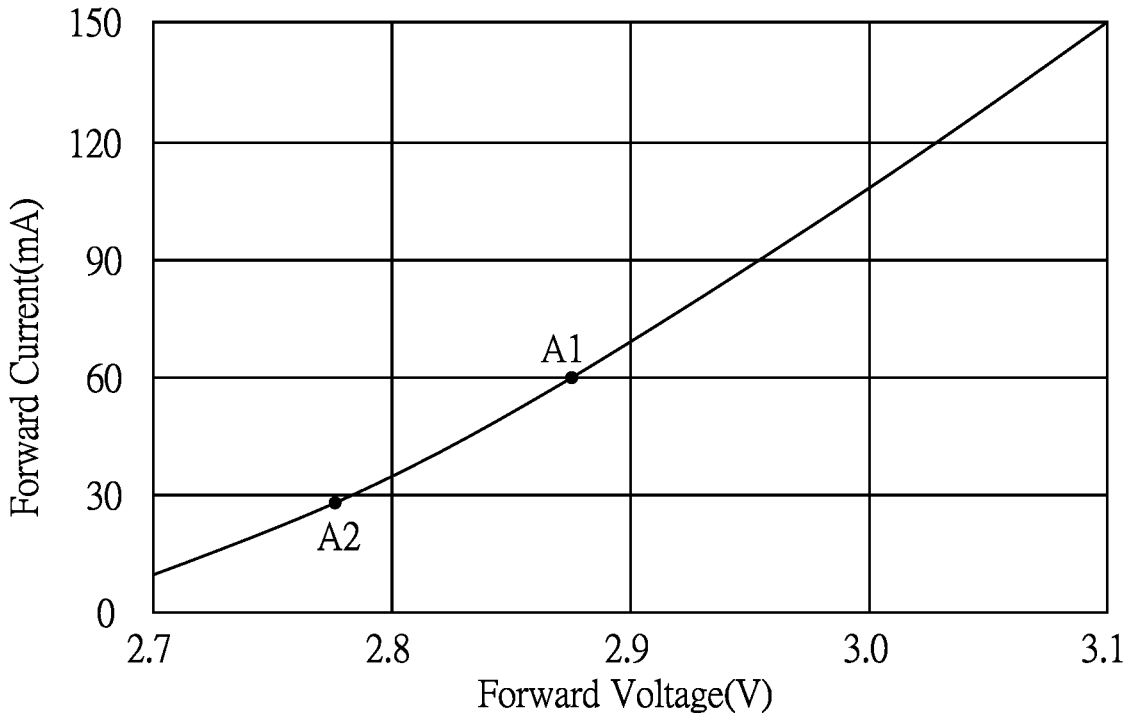
FIG. 4 is a diagram illustrating the relationship between the forward current and forward voltage of the LED lighting load of the embodiment of the present invention.

Referring to FIG. 1 and FIG. 4, the LED lighting load D3 that is commercially available is taken as an example. If the LED lighting load D3 is marked as 8 W, the product of the operating current of the LED lighting load D3 and the input voltage is 8 W. Hereinafter, the LED lighting loads D3 of the same size and the same 8 W are divided into a control group A1 that is not boosted and a test group A2 that is boosted. The experimental group A2 is the present invention. If the voltage of the mains electricity input to the mains AC input terminals L1, L2 is 132V, the operating current of the control group A1 is that 8 W divided by 132V approximately equals 60 mA. After the voltage boosted by the first diode D1 and the second diode D2 is raised to 276V, the operating current of the experimental group A2 is that 8 W divided by 276V approximately equals 28 mA. FIG. 4 illustrates the relationship between the forward current and forward voltage of the LED lighting load D3. When the control group A1 is operated at 60 mA, the operating voltage of the control group A1 is about 2.88V, and the electric power of the actual operation of the control group A1 is that 60 mA multiplied by 2.88V is 0.1728 W. When the experimental group A2 is operated at 28 mA, the operating voltage of the experimental group A2 is about 2.77V, and the electric power of the actual operation of the experimental group A2 is that 28 mA multiplied by 2.77V is 0.07756 W.

Figure 5:
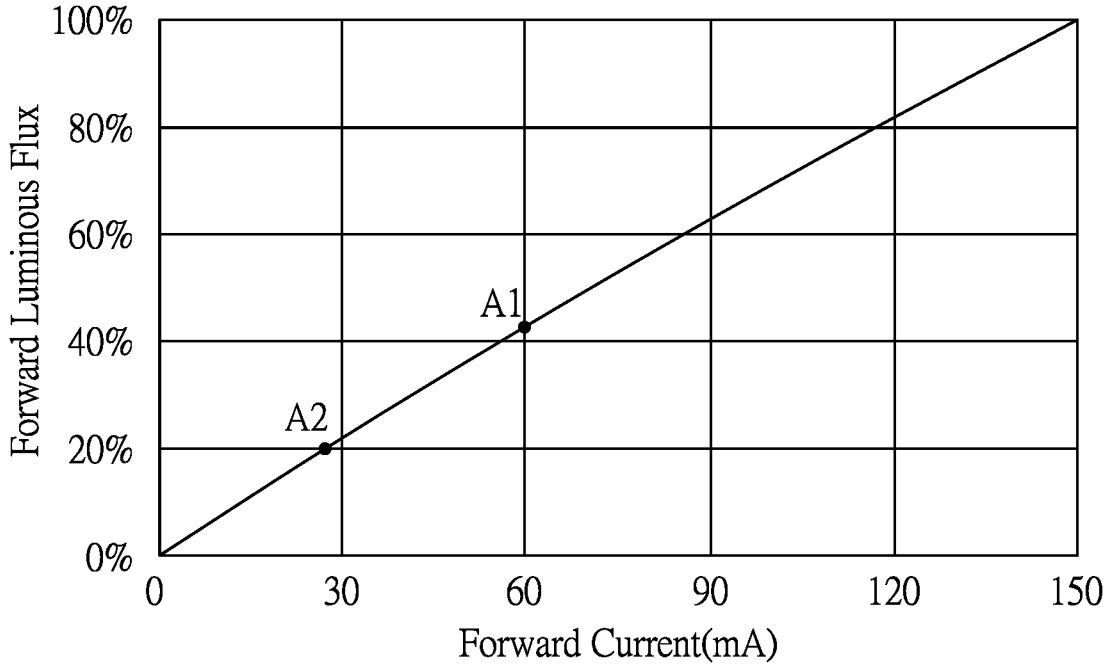
FIG. 5 is a diagram illustrating the relationship between the forward luminous flux and forward current of the LED lighting load of the embodiment of the present invention.

Please refer to FIG. 1 and FIG. 5. FIG. 5 shows the relationship between the forward luminous flux and the forward current of the LED lighting load D3. When the control group A1 is operated at 60 mA, the forward luminous flux of the control group A1 is about 41%, and the luminous efficiency of the control group A1 is that 41% divided by 0.1728 W approximately equals 237.26 $W^{-1}$. When the experimental group A2 is operated at 28 mA, the forward luminous flux of the experimental group A2 is about 20%, and the luminous efficiency of the experimental group A2 is that 20% divided by 0.07756 W approximately equals 257.86 $W^{-1}$. It should be noted that the forward luminous flux of the vertical axis in FIG. 5 is the maximum luminous flux relative to the LED lighting load D3. Since the control group A1 and the experimental group A2 use the LED lighting loads D3 having the same maximum luminous flux, only the forward luminous flux is calculated. From the above calculations, it can be known that the luminous efficiency of the experimental group A2 is indeed higher than that of the control group A1 after the operating voltage is raised and the operating current is lowered.

Based on the foregoing calculation, in the case that the LED lighting load D3 of the same size is used, according to the characteristics of the voltage and current of the LED lighting load D3, when the voltage the LED lighting load D3 is raised and the current is lowered, the luminous efficiency can be improved. Alternatively, by connecting the same number of LED lighting loads D3 in series, the same power, lower heat generation and increased luminous efficiency can be achieved. Therefore, the manufacturer can manufacture the LED lighting load D3 with a high wattage for the luminous efficiency of the LED lighting load D3 to be better, but the current flowing through the LED lighting load D3 is not increased, thereby achieving the energy saving effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An LED lighting device driven by boosting alternating current, comprising:

a mains AC input terminal, configured to supply mains electricity;

an LED lighting load, an operating voltage of the LED lighting load being 1.5 times to 6 times an effective voltage of the mains electricity;

an AC boosting driving circuit, electrically connected to the mains AC input terminal and the LED lighting load, and configured to charge a first boosting capacitor during a first partial cycle of the mains electricity and a second boosting capacitor during a second partial cycle of the mains electricity, the first and second boosting capacitors being charged to collectively apply both forward boosting and reverse boosting to the mains electricity supplied through the mains AC input terminal; and a constant current driver electrically connected to the LED lighting load operating to maintain current passing through the LED lighting load at a constant value;

wherein the mains electricity is thereby boosted to 1.5 to 6 times in voltage to drive the LED lighting load during both the first and second partial cycles of the mains electricity.

2. The LED lighting device driven by boosting alternating current as claimed in claim 1, wherein the AC boosting driving circuit includes a forward boosting module coupled to the first boosting capacitor and a reverse boosting module coupled to the second boosting capacitor, a positive half cycle of the mains electricity is boosted by the forward boosting module, and a negative half cycle of the mains electricity is boosted by the reverse boosting module.

3. The LED lighting device driven by boosting alternating current as claimed in claim 2, wherein a positive electrode of the first boosting capacitor being electrically connected to an output terminal of the forward boosting module and a positive electrode of the LED lighting load, a negative electrode of the second boosting capacitor being electrically connected to an output terminal of the reverse boosting module.

4. The LED lighting device driven by boosting alternating current as claimed in claim 3, wherein the constant current driver is electrically connected to a cathode of the LED lighting load.

5. The LED lighting device driven by boosting alternating current as claimed in claim 2, wherein the forward boosting module is a first diode.

6. The LED lighting device driven by boosting alternating current as claimed in claim 2, wherein the reverse boosting module is a second diode.

7. The LED lighting device driven by boosting alternating current as claimed in claim 3, wherein a negative electrode of the first boosting capacitor is electrically connected to a positive electrode of the second boosting capacitor at a node electrically connected to the mains AC input terminal and to electrodes of first and second resistors respectively disposed in parallel to the first and second boosting capacitors.

* * * * *